US011369214B2

(12) United States Patent
Hawkins

(10) Patent No.: US 11,369,214 B2
(45) Date of Patent: Jun. 28, 2022

(54) COOLER WITH SHELF PLENUM

(71) Applicant: THE COCA-COLA COMPANY, Atlanta, GA (US)

(72) Inventor: Alan Hawkins, Conyers, GA (US)

( * ) Notice: Subject to any disclaimer, the term of this patent is extended or adjusted under 35 U.S.C. 154(b) by 273 days.

(21) Appl. No.: 16/467,441

(22) PCT Filed: Nov. 30, 2017

(86) PCT No.: PCT/US2017/064070
§ 371 (c)(1),
(2) Date: Jun. 6, 2019

(87) PCT Pub. No.: WO2018/102611
PCT Pub. Date: Jun. 7, 2018

(65) Prior Publication Data

US 2020/0069078 A1 Mar. 5, 2020

Related U.S. Application Data

(60) Provisional application No. 62/428,516, filed on Nov. 30, 2016.

(51) Int. Cl.
*A47F 3/04* (2006.01)
*F25D 17/06* (2006.01)
*F25D 25/02* (2006.01)

(52) U.S. Cl.
CPC ..... *A47F 3/0408* (2013.01); *F25D 17/062* (2013.01); *F25D 25/02* (2013.01); *A47F 2003/046* (2013.01); *F25D 2317/0655* (2013.01)

(58) Field of Classification Search
CPC ..... A47F 3/0408; A47F 2003/046; A47F 3/0491; A47F 3/0443; F25D 17/062;
(Continued)

(56) References Cited

U.S. PATENT DOCUMENTS 2,490,413 A * 12/1949 Burtis ..... A47F 3/0465 62/249
3,115,019 A * 12/1963 Rutishauser ..... A47F 3/0443 62/256

(Continued)

FOREIGN PATENT DOCUMENTS

WO 2007053002 A1 5/2007

OTHER PUBLICATIONS

Kim, Jin Ho; International Search Report & Written Opinion; dated Mar. 16, 2018; pp. 1-13; Korean Intellectual Property Office, Daejeon, Republic of Korea.

*Primary Examiner* — David J Teitelbaum

(57) ABSTRACT

Systems and methods are disclosed herein that include providing a cooler with a supply duct, a plurality of shelf plenums connected in fluid communication with the supply duct, and a return duct to implement precise temperature control over an internal cooling space of the cooler. Each of the shelf plenums may include openings disposed in a top surface of each shelf plenum. A supply airflow generated by a fan of a refrigeration system may pass the supply airflow through the supply duct to each of the plurality of shelf plenums, where the supply airflow may exit the shelf plenums through the openings in each shelf plenum to directly contact beverages and/or food products disposed on the top surface of the shelf plenums. The cooler may be further operated to supercool liquid beverages below a freezing point of the beverages without causing solidification and/or crystallization of the beverages.

19 Claims, 6 Drawing Sheets

(58) Field of Classification Search
CPC ..... F25D 2317/0655; F25D 25/02; F25D 25/028; F24F 7/10
See application file for complete search history.

(56) References Cited

U.S. PATENT DOCUMENTS

| | | | | |
|---|---|---|---|---|
| 3,584,467 | A * | 6/1971 | Barroero | A47F 3/0443 62/252 |
| 4,671,074 | A * | 6/1987 | Gostelow | F25D 17/065 62/186 |
| 6,971,247 | B2 * | 12/2005 | Yamazaki | A47F 3/0443 454/193 |
| 7,137,438 | B2 * | 11/2006 | Nomura | A47F 3/0443 165/64 |
| 2003/0031777 | A1 | 2/2003 | Lucatello | |
| 2003/0172670 | A1 | 9/2003 | Vormedal | |
| 2005/0126205 | A1 * | 6/2005 | Schmid | F25D 17/065 62/407 |
| 2006/0199495 | A1 * | 9/2006 | Yamaguchi | A47F 3/0491 454/173 |
| 2006/0240761 | A1 | 10/2006 | Yamaguchi | |
| 2008/0245079 | A1 * | 10/2008 | Lim | F25D 23/12 62/66 |
| 2008/0245081 | A1 | 10/2008 | Shin et al. | |
| 2010/0058789 | A1 * | 3/2010 | Barreto | A47F 3/0443 62/251 |
| 2016/0025402 | A1 * | 1/2016 | Ahn | F25D 17/065 62/419 |
| 2018/0274842 | A1 * | 9/2018 | Yanagisawa | F25D 31/007 |

* cited by examiner

COOLER WITH SHELF PLENUM

CROSS-REFERENCE TO RELATED APPLICATIONS

The present application claims priority to International PCT Application No. PCT/US17/064070 filed on 30 Nov. 2017 and U.S. Provisional Application No. 62/428,516 filed with the United States Intellectual Property Office on Nov. 30, 2016 and entitled "COOLER WITH SHELF PLENUM," which is incorporated herein by reference in their entirety for all purposes

STATEMENT REGARDING FEDERALLY SPONSORED RESEARCH OR DEVELOPMENT

Not applicable.

REFERENCE TO A MICROFICHE APPENDIX

Not applicable.

BACKGROUND

Coolers and/or freezers are seemingly common in venues such as grocery stores, convenience stores, etc. Coolers and/or freezers often allow a consumer access to the beverages and/or food products stored in the cooler and/or freezer through a door and/or multiple doors. When multiple consumers open a door of the cooler and/or freezer repeatedly to access the beverages and/or food products, the temperature-conditioned air within the cooler and/or freezer may transfer heat with an ambient air outside of the cooler. As a result, the temperature within the cooler and/or freezer may increase to an undesirable level (or decrease to an undesirable level in the case of a heated cooler), and/or an undesirable temperature gradient within the cooler and/or freezer may result, thereby causing some beverages and/or food products to have higher and/or lower temperatures within the same cooler and/or freezer.

SUMMARY

In some embodiments of the disclosure, a cooler is disclosed as comprising: a supply duct; a plurality of shelf plenums connected in fluid communication with the supply duct, each shelf plenum comprising a shelf configured to support a plurality of beverages thereon, and each shelf comprising a plurality of openings disposed through each shelf; a return duct; and a refrigeration system comprising a fan configured to generate a supply airflow through the supply duct to each of the plurality of shelf plenums, wherein the supply airflow exits the shelf plenums through the plurality of openings in each shelf.

In other embodiments of the disclosure, a cooler is disclosed as comprising: a supply duct; at least one shelf plenum connected in fluid communication with the supply duct and extending into an interior cooling space of the cooler; and a fan configured to generate a supply airflow through the supply duct and the at least one shelf plenum into an interior cooling space of the cooler.

In yet other embodiments of the disclosure, a method of operating a cooler is disclosed as comprising: disposing at least one beverage container on a first shelf plenum; generating a supply airflow through the first shelf plenum; passing the supply airflow through a plurality of openings disposed in the first shelf plenum; directly contacting the at least one beverage container with the supply airflow; and supercooling a liquid within the at least one beverage container.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
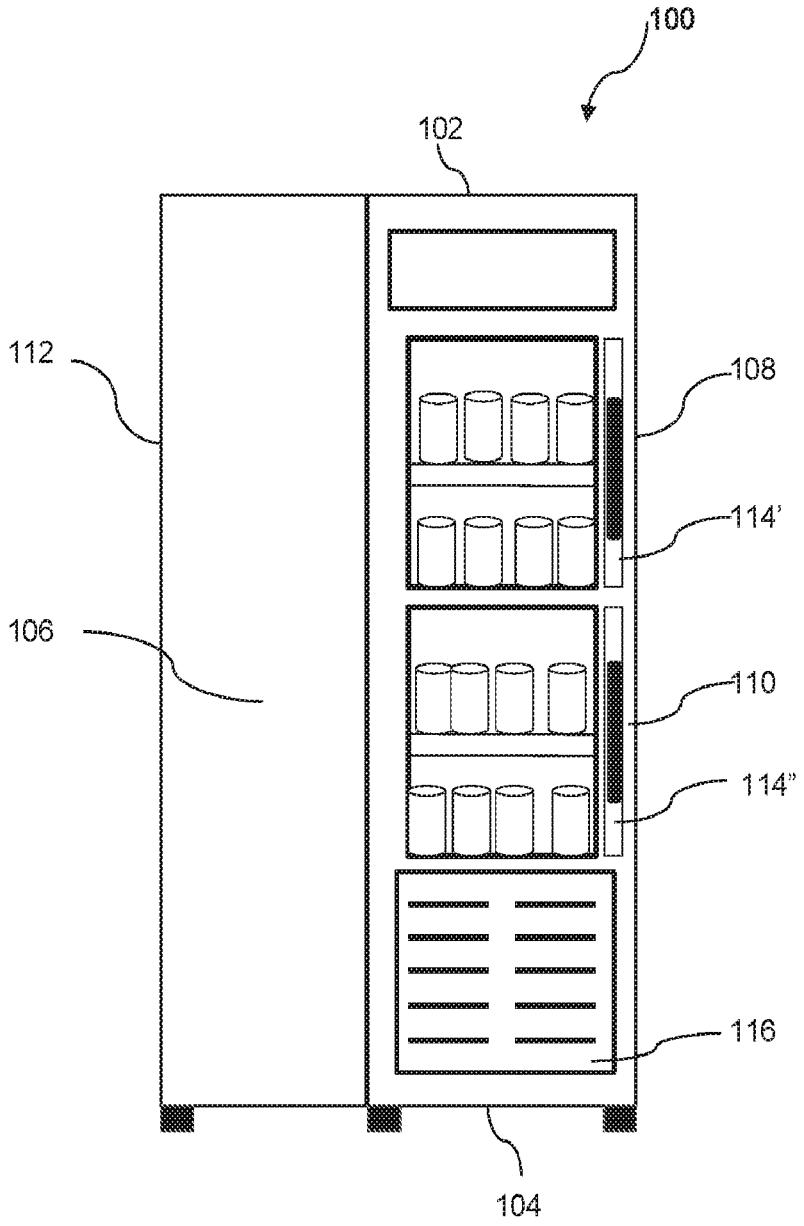
FIG. 1 is an oblique view of a cooler according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

In coolers that comprise a door to allow consumers access to the beverages and/or food products stored in the cooler, multiple consumers may often access the beverages and/or food products stored in the cooler through the door and/or through multiple doors of the same cooler. When multiple consumers open a door of the cooler repeatedly to access the beverages and/or food products, the cold air within the cooler may transfer heat with an ambient air outside of the cooler. Additionally, in traditional coolers, air is circulated in a fashion that may cause some beverages and/or food products to receive more or less airflow than others. As a result, the temperature within the cooler may increase to an undesirable level (or decrease to an undesirable level in the case of a heated cooler), and/or an undesirable temperature gradient within the cooler may result, thereby causing some beverages and/or food products to have higher and/or lower temperatures within the same cooler.

Therefore, the present disclosure provides a cooler comprising a refrigeration system configured to implement one or more substantially closed thermodynamic refrigeration cycles to provide a cooling functionality to an airflow circulated through the cooler. The temperature-conditioned airflow may be circulated by a circulation fan of the refrigeration system and passed through a main supply duct of the cooler to each of a plurality of shelf plenums connected in fluid communication with the main supply duct. The shelf plenums may generally comprise a plurality of openings, whereby the airflow may exit the shelf plenums. The shelf plenums may also be configured to support and/or carry a plurality of beverages and/or food products, such that the airflow exiting the shelf plenums through the plurality of openings may directly contact the beverages and/or food products stored on an upper surface (shelf) of the shelf plenums (e.g., up through the bottom of the beverage container). Additionally, the shelf plenums may also be arranged and/or configured such that return air may be returned to the refrigeration system by traveling around the outside of each side of the shelf plenums. Therefore, in some embodiments, the shelf plenums may be configured to supercool a plurality of beverages and/or food products within a cooler to a temperature of about 25 degrees Fahrenheit. Additionally, in some embodiments, the shelf plenums may be configured to preserve a temperature gradient within the cooler. Still further, at least in some embodiments, the shelf plenums may comprise dampers that allow even more precise temperature control of the beverages and/or food products stored on each individual shelf plenum and/or within the cooler as a whole.

Referring now to FIG. 1, an oblique view of a cooler 100 is shown according to an embodiment of the disclosure. The cooler 100 generally comprises a top 102, a bottom 104, a left side 106, a right side 108, a front 110, and a back 112. Such directional descriptions are meant to assist the reader in understanding the physical orientation of the various components parts of the cooler 100. However, such directional descriptions shall not be interpreted as limitations to the configurations of the cooler 100. Attachment of directional descriptions at different locations or different components of the cooler 100 shall not be interpreted as indicating absolute locations of directional limits of the cooler 100. Instead, a plurality of shown and/or labeled directional descriptions in a single figure shall provide general directional orientation to the reader so that directionality may be easily followed amongst the various figures. Still further, the component parts and/or assemblies of the cooler 100 may be described below as generally having top, bottom, left, right, back, and front sides which should be understood as being consistent in orientation with the top 102, bottom 104, left side 106, right side 108, front 110, and back 112 of the cooler 100.

Figure 2:
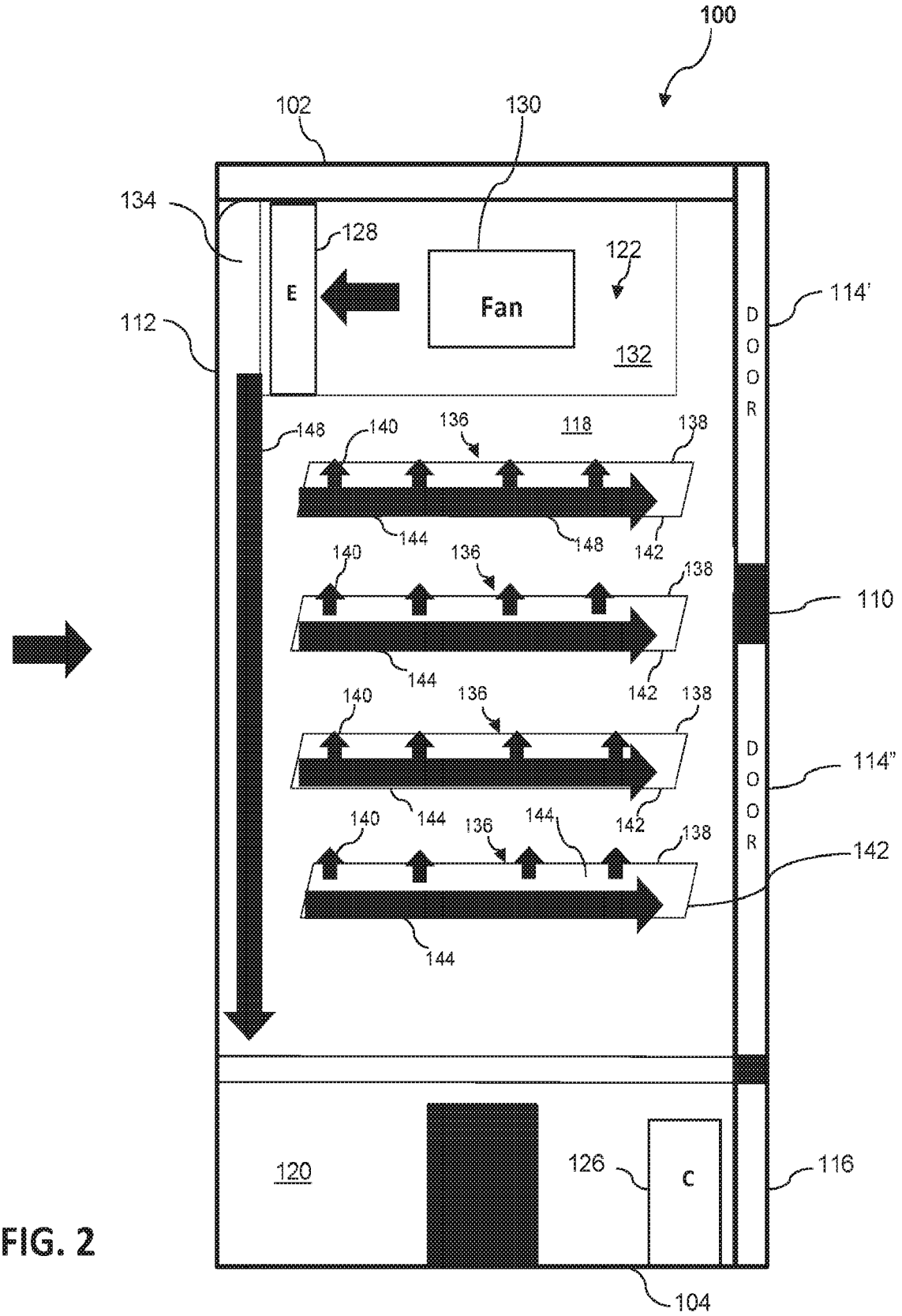
FIG. 2 is an orthogonal left side view of the cooler of FIG. 1 according to an embodiment of the disclosure.
Figure 3:
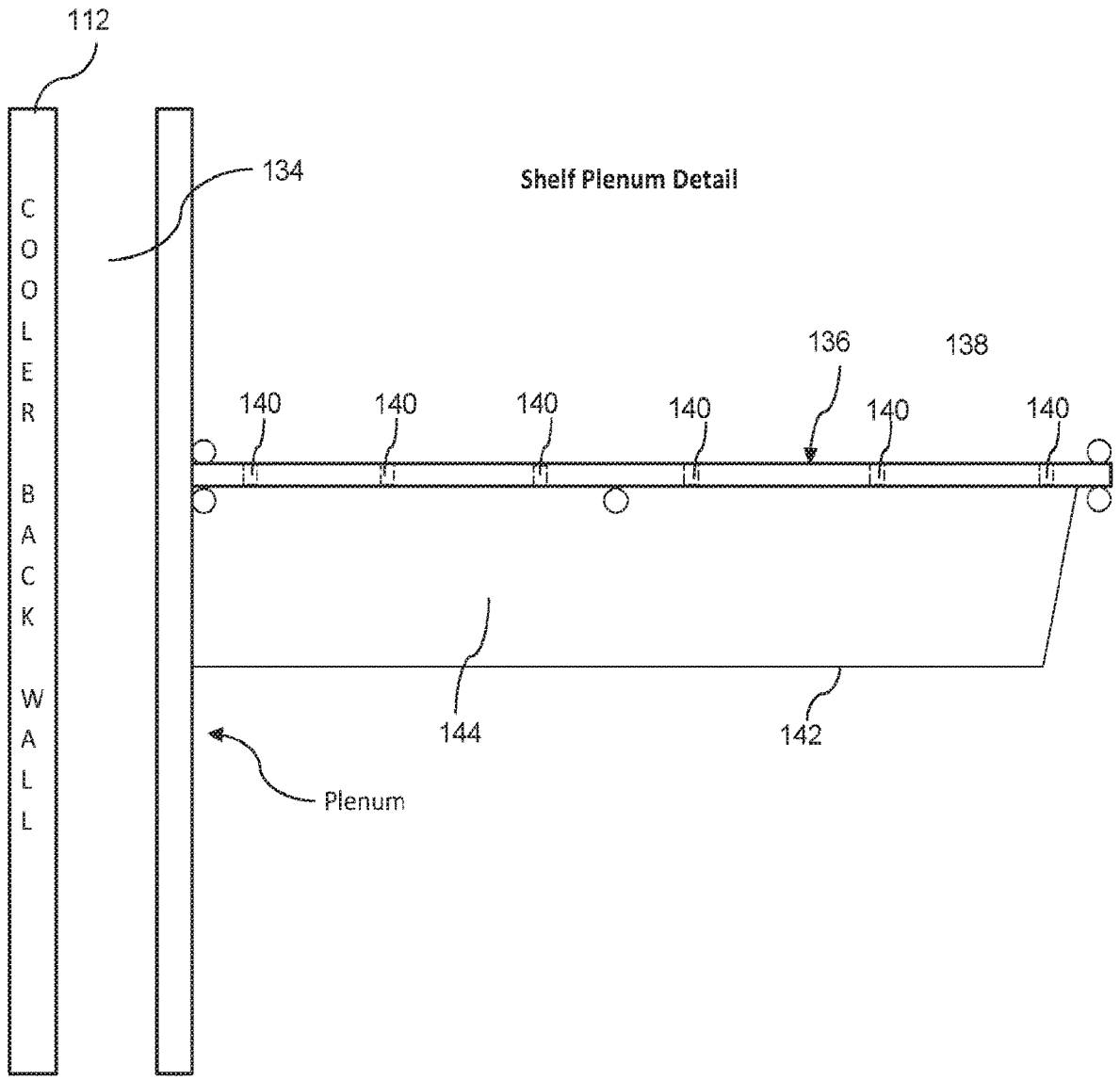
FIG. 3 is a detailed orthogonal left side view of a shelf plenum of the cooler of FIGS. 1 and 2 according to an embodiment of the disclosure.

Referring now to FIGS. 2 and 3, an orthogonal left side 106 view of the cooler 100 and a detailed orthogonal left side 106 view of a shelf plenum 136 of the cooler 100 of FIGS. 1 and 2 are shown according to an embodiment of the disclosure. The cooler 100 may generally comprise at least one door 114 disposed on a front 110 side of the cooler 100 and configured to allow a consumer access to an interior cooling space 118 of the cooler 100. In this embodiment, the cooler 100 comprises two doors 114, a top door 114' and a bottom door 114". However, in other embodiments, the cooler 100 may comprise two doors 114 disposed side by side on the front 110 of the cooler 100 or some other number of doors. Additionally, the cooler 100 may comprise a vent panel 116 that may cover a lower space 120. The vent panel 116 may generally be formed from a sheet metal material and comprise a plurality of vents and/or louvers.

The cooler 100 may also comprise a refrigeration system 122 that may be configured to implement one or more substantially closed thermodynamic refrigeration cycles to provide a cooling functionality to an airflow circulated through the cooler 100. The refrigeration system 122 may generally comprise a compressor 124, a condenser 126, an evaporator 128, and a fan 130. Additionally, it will be appreciated that the refrigeration system 122 may also comprise other components that contribute to operation of the refrigeration system (e.g., an expansion valve, refrigeration system controller, etc.) of the cooler 100. The compressor 124 is generally configured to selectively circulate a refrigerant at a plurality of mass flow rates through internal plumbing and the heat exchangers (condenser 126, evaporator 128) of the refrigeration system 122. The evaporator 128 is generally configured to transfer heat to the refrigerant circulated by the compressor 124 to cool a passing airflow generated by the fan 130, while the condenser 126 is configured to discharge heat absorbed by the refrigerant to ambient air. Additionally, while not shown, it will be appreciated that the condenser 126 may also comprise a fan to enable the condenser 126 to exchange heat with an ambient airflow that contacts the condenser 126.

In some embodiments, the compressor 124 and the condenser 126 may be disposed within the lower space 120 of the cooler 100. Accordingly, the plurality of vents and/or louvers in the vent panel 116 may allow heat discharged by the condenser 126 to escape from the lower space 120. However, in some embodiments, the back 112 of the lower space 120 may remain substantially open, such that the plurality of vents and/or louvers may allow an incoming airflow to contact the condenser 126, so that heat may be discharged through the open lower space 120 in the back 112 of the cooler 100. The evaporator 128 and the fan 130 may generally be disposed in a return duct 132 disposed near the top 102 of the cooler 100. As will be discussed in greater detail herein, the fan 130 may generally be configured to generate a supply airflow 148 to deliver temperature-conditioned air through the cooler 100. In some embodiments, the airflow generated by the fan 130 may be configured to "supercool" a beverage and/or food product disposed within the interior cooling space 118 of the cooler 100.

The cooler 100 generally comprises a supply duct 134 configured as a main supply fluid flowpath that extends from a downstream side of the evaporator 128 along a back 112 of the interior cooling space 118 of the cooler 100. The cooler 100 also comprises a plurality of shelf plenums 136. However, in some embodiments, the cooler 100 may only comprise a single shelf plenum 136. The shelf plenums 136 may each be connected in fluid communication with the main supply duct 134 and be configured as fluid ducts that may receive the supply airflow 148 from the supply duct 134 therethrough. The shelf plenums 136 may each generally comprise a shelf 138 comprising a plurality of openings 140 that extend through the shelf 138, and a bottom portion 142. Collectively, the shelf 138 and the bottom portion 142 form a plenum 144 configured as a fluid duct that extends from the supply duct 134 through the shelf plenum 136. Accordingly, the supply airflow 148 generated by the fan 130 may pass through the supply duct 134, be distributed through the plurality of shelf plenums 136, and exit the shelf plenums 136 into the interior cooling space 118 through the openings 140 disposed in the shelf 138 of each shelf plenum 136.

Each shelf 138 may generally be configured to support and/or carry a plurality of beverages and/or food products. In some embodiments, each shelf 138 may comprise a traditional wire rack. For example, each shelf 138 may comprise a traditional wire shelf formed from ¼" rods and comprise a plurality of openings 140 therethrough in the form of channels and/or slits formed between the rods. Thus, when a plurality of beverages and/or food products are disposed on the shelf 138, the beverages and/or food products may at least partially block the openings 140 and/or restrict the supply airflow 148 exiting the openings 140 to form the plenum 144. However, in other embodiments, each shelf 138 may be formed from a polymer, a coated metal, and/or any other rigid material. For example, in some embodiments, each shelf 138 may comprise Lexan and comprise a plurality of openings 140 therethrough in the form of round holes, elongated slits, or another shaped opening. The bottom portion 142 of each shelf 138 may also be formed from Lexan. In some embodiments, the openings 140 may comprise a plurality of elongated slits between members (e.g., rods) that collectively form each shelf 138. In other embodiments, each shelf 138 may comprise a solid surface having a plurality of holes, slits, and/or alternative-shaped openings 140 arranged in a grid across each shelf 138.

In some embodiments, the openings 140 may generally be arranged across each shelf 138 in a uniform grid and comprise a substantially similar size. However, in other embodiments, the size of the openings 140 may vary. For example, the size of the openings towards the back 112 of the cooler 100 may be smaller and increase in size toward the front 110 of the cooler 100. In another example, the size of the openings 140 toward the bottom 104 of the cooler may be smaller and increase in size toward the top 102 of the cooler 100. In some embodiments, the size, spacing, number, and/or arrangement of the openings 140 may be dependent upon factors such as, but not limited to, the size of the interior cooling space 118 of the cooler, size and/or capacity of the components of the refrigeration system 122, desired range of temperatures of the supply airflow 148, amount of desired heat transfer between the supply airflow 148 and the beverages and/or food products, the environment in which the cooler 100 is installed, and/or size, weight, and/or profile of the beverages and/or food products to be refrigerated in the cooler 100.

The shelves 138 may generally be oriented in a substantially flat, level configuration. In other embodiments, the shelves 138 may be disposed at an angle. Still further, the shelves 138 may be adjustable and/or configured to support and/or carry a plurality of beverages and/or food products in a plurality of orientations.

In operation, the supply airflow 148 generated by the fan 130 may produce a positive pressure within the supply duct 134 and consequently, the shelf plenums 136. The supply airflow 148 may pass through the supply duct 134, be distributed through the plurality of shelf plenums 136, and exit the shelf plenums 136 into the interior cooling space 118 through the openings 140 disposed in the shelf 138 of each shelf plenum 136. Accordingly, when a plurality of beverages and/or food products are disposed on the shelves 138, the supply airflow 148 that exits each shelf plenum 136 through the plurality of openings 140 may directly contact the beverages and/or food products disposed on each shelf 138. In some embodiments, by having the supply airflow 148 delivered into the interior cooling space 118 through the plurality of openings 140 in the shelf plenums 136, the need for multiple fans may be eliminated. This may be due, at least in part, to the supply airflow 148 being distributed more evenly through the plurality of openings 140 in the shelf plenums 136 as compared to a traditional cooler that comprises only a single supply air opening. Thus, in some embodiments, cooler 100 only requires a single circulating fan 130, which may reduce a temperature gradient throughout the interior cooling space 118 of the cooler 100.

Additionally, by disposing the openings 140 in each of the plurality of shelves 138, the supply airflow 148 exiting through the plurality of openings 140 may directly contact the beverages and/or food products disposed on each shelf 138 on a bottom side of the beverages and/or food products. As a result of the direct contact between the supply air 148 exiting through the plurality of openings 140, more heat transfer may occur between the supply airflow 148 and the beverages and/or food products as compared to a traditional cooler since the supply airflow 148 does not contact/mix with any air within the interior space 118 of the cooler 100 that has already exchanged heat with the beverages and/or food products until the supply airflow 148 leaves each shelf plenum 136. As such, the cooler 100 may be configured to provide a supercooling effect (i.e. supercool) the beverages and/or liquid-form food products. Supercooling may be defined as cooling a liquid below its freezing point without solidification or crystallization. Thus, in the case of cooler 100, beverages disposed within the interior cooling space 118 of the cooler 100 may be supercooled, thereby providing a beverage in liquid form that is substantially colder than a beverage from a traditional cooler.

Figure 4:
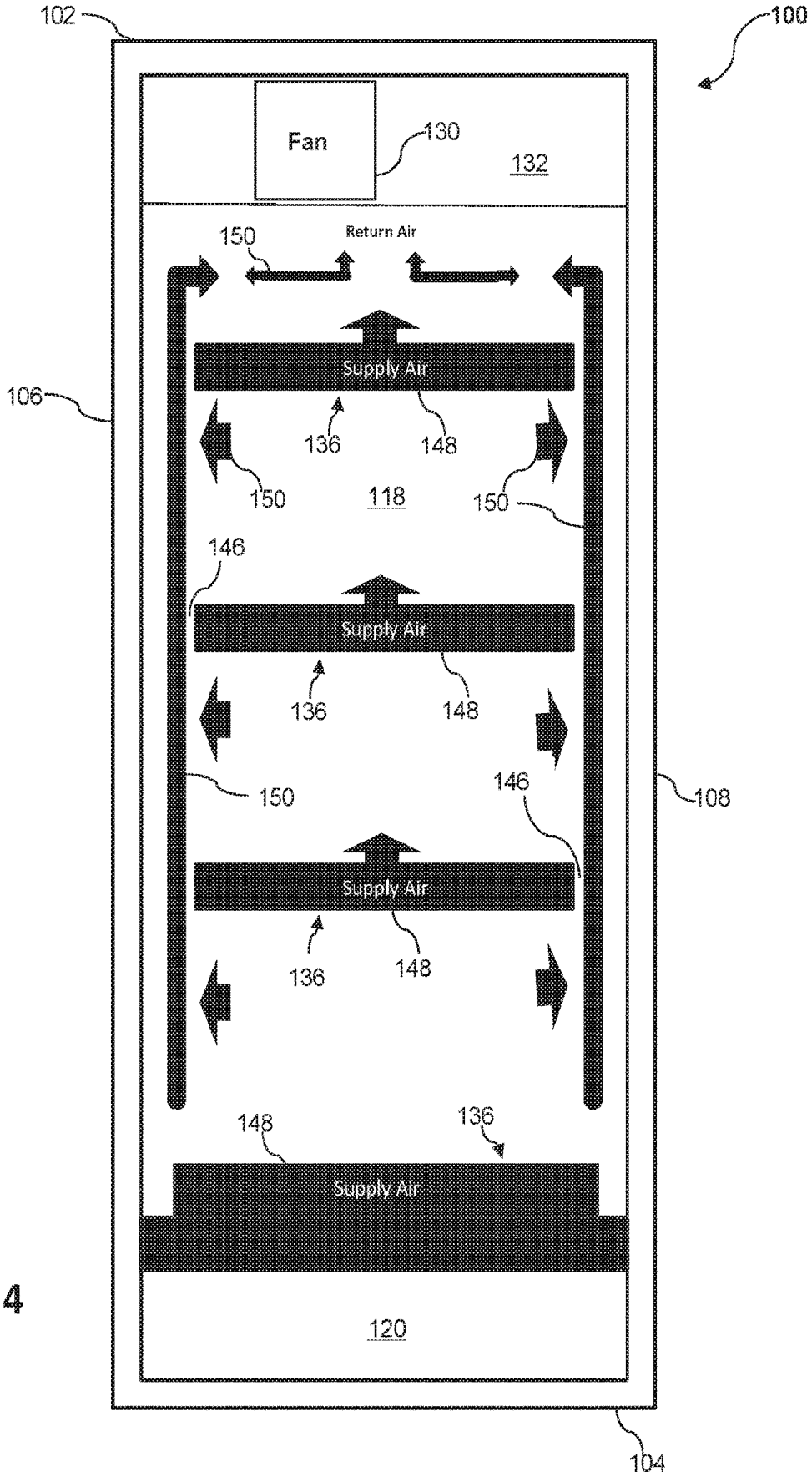
FIG. 4 is an orthogonal front view of the of the cooler of FIGS. 1 and 2 according to an embodiment of the disclosure.

Referring now to FIG. 4, an orthogonal front 110 view of the cooler 100 of FIGS. 1 and 2 is shown according to an embodiment of the disclosure. As stated, the fan 130 may generally be disposed in the return duct 132 disposed near the top 102 of the cooler 100 and configured to generate a supply airflow 148 to deliver temperature-conditioned air through the cooler 100. The supply airflow 148 may be delivered through the supply duct 134 through the shelf plenums 136 and into the interior cooling space 118 through the plurality of openings 140 in the shelf plenums. When a plurality of beverages and/or food products are disposed on the shelves 138 of the shelf plenums 136, the supply airflow 148 that exits each shelf plenum 136 through the plurality of openings 140 may directly contact the beverages and/or food products disposed on each shelf 138, thereby transferring heat from the beverages and/or food products to the supply airflow 148. Air that has exchanged heat with the beverages and/or food products in the cooler 100 may be passed through the cooler 100 to the return duct 132, and thus may be referred to as a return airflow 150.

The shelf plenums 136 may also be configured such that gaps 146 exist between each shelf plenum 136 and each of a left side 106 and right side 108 of the interior cooling space 118 of the cooler 100. After the supply airflow 148 has exchanged heat with the beverages and/or food products, the resultant heated return airflow 150 may be forced to the left side 106 and/or the right side 108 of the interior cooling space 118 of the cooler 100. The return airflow 150 may be forced and/or flow substantially parallel to and/or along the left side 106 and right side 108 of the interior cooling space 118 between the shelf plenums 136 and the left side 106 and right side 108, respectively, towards the top 102 of the cooler 100. When the return airflow reaches the top 102 of the interior cooling space 118 of the cooler 100, the return airflow 150 may enter the return duct 132, where the refrigeration cycle may be repeated and the airflow may be temperature-conditioned by the refrigeration system 122.

By forcing the return airflow 150 to the sides 106, 108 of the interior cooling space 118 of the cooler 100, the return airflow 150 may be prevented from contacting other beverages and/or food products after initially exiting the openings 140 and exchanging heat with the beverages and/or food products disposed substantially directly above each opening 140. In some embodiments, the return airflow 150 may also be prevented from exchanging heat with the incoming supply airflow 148 and/or the beverages and/or food products disposed in the cooler 100. Thus, heat from the return airflow 150 may be prevented from redistributing to the supply airflow 148 and/or the beverages and/or food products disposed in the cooler 100. In the case of cooler 100, the return airflow path provided by the gaps 146 may contribute to the supercooling effect of the cooler 100 on beverages and/or liquid-form food products disposed within the interior cooling space 118 of the cooler 100.

In some embodiments, beverages and/or liquid-form food products disposed within the interior cooling space 118 of the cooler 100 may be supercooled to a temperature of about 25 degrees Fahrenheit without freezing. However, in other embodiments, beverages and/or liquid-form food products may be supercooled to a temperature of about 23 degrees Fahrenheit, about 24 degrees Fahrenheit, about 26 degrees Fahrenheit, and/or at least about 27 degrees Fahrenheit. It will be appreciated that the cooler 100 may be configured to supercool any beverages and/or liquid-form food products below their freezing points without the beverages and/or liquid-form food products freezing through solidification and/or crystallization. To supercool any beverage and/or liquid-form food product, the supply airflow 148 temperature may be between about 20 degrees Fahrenheit to about 21 degrees Fahrenheit. However, in other embodiments, the supply airflow 148 temperature may be about 18 degrees Fahrenheit up to about 27 degrees Fahrenheit.

Since supercooling a beverage and/or liquid-form food product requires precise temperature control, the cooler 100 may be configured to control the temperature distribution throughout the interior cooling space 118 by substantially reducing a temperature gradient within the interior cooling space 118. Still further, it will be appreciated that the return duct 132 may also prevent warm return airflow 150 from lingering over beverages and/or liquid-form food products disposed on a top shelf closest to the return duct 132, which may be the case in traditional coolers. In an embodiment, to help prevent warm return airflow 150 from lingering at the top 102 of the cooler 100, the cooler 100 may comprise a false plenum (similar to the shelf plenum 136 discussed above, but without having beverages and/or liquid form food product stored thereon) above the top shelf closest to the return duct 132.

Figure 5:
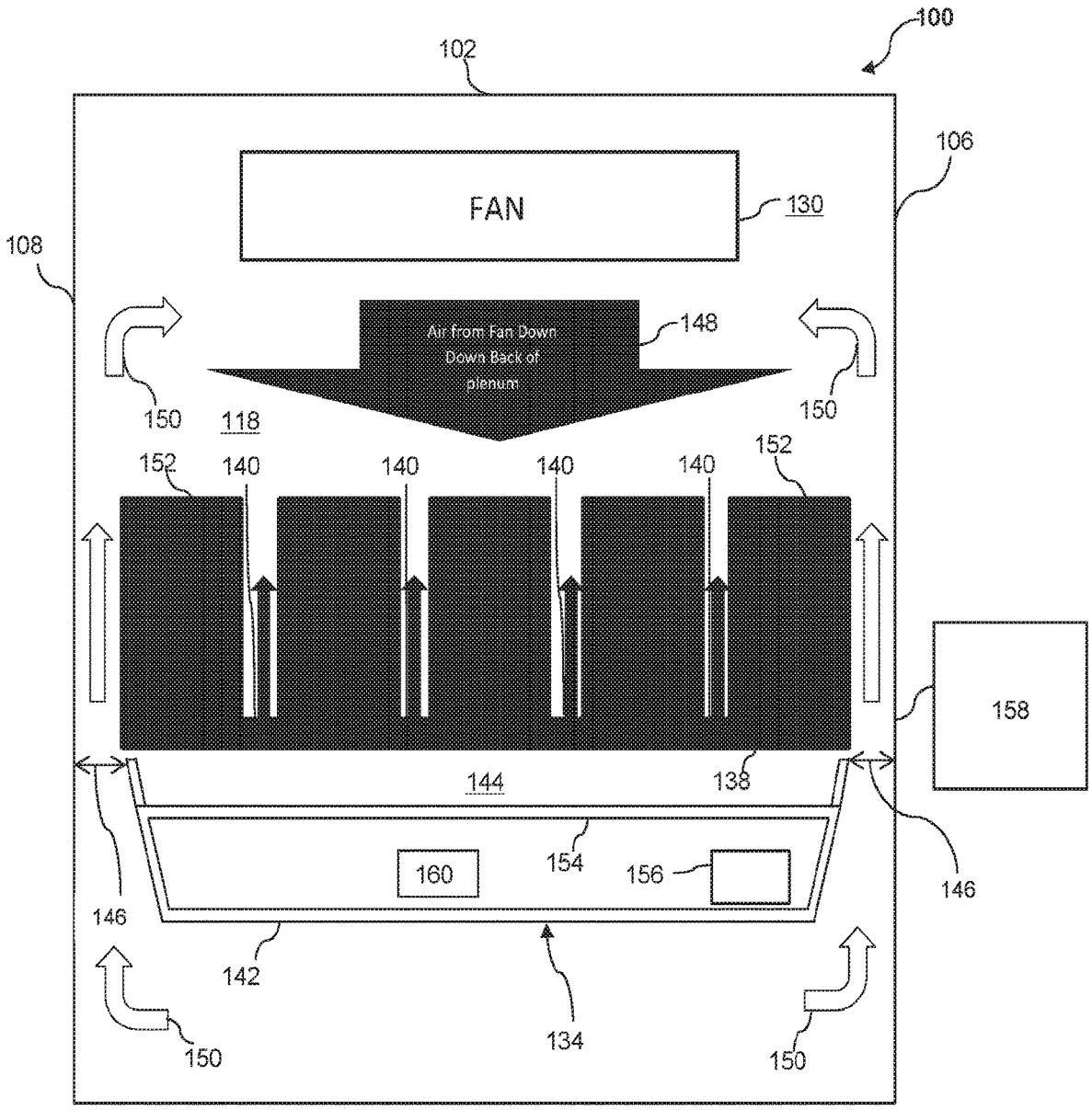
FIG. 5 is an orthogonal front view of a shelf plenum of the cooler of FIGS. 1, 2, and 4 according to an embodiment of the disclosure.

Referring now to FIG. 5, a detailed orthogonal front 110 view of a shelf plenum 136 of the cooler of FIGS. 1, 2, and 4 is shown according to an embodiment of the disclosure. The cooler 100 is shown with a plurality of beverage containers 152 disposed on a shelf 138 of a shelf plenum 136. Additionally, in this embodiment, the shelf plenum 136 may comprise a damper 154 configured to control the supply airflow 148 through the shelf plenum 136. However, it will be appreciated that in some embodiments, each shelf plenum 136 may comprise a damper 154, such that the cooler comprises a plurality of dampers 154. The dampers 154 may comprise a selectively positionable register-style damper, butterfly-style damper, linear slide damper, a plurality of louvers, a shutter and/or plurality of shutters, and/or any other selectively positionable device configured to control the supply airflow 148 through the shelf plenum 136.

In some embodiments, the dampers 154 may be actuated and/controlled manually, electronically, pneumatically, hydraulically, and/or mechanically. Additionally, in some embodiments, the dampers 154 may be actuated and/or controlled by a damper motor 156. In addition, each shelf plenum 136 may comprise a temperature sensor and/or a pressure sensor that may provide feedback to a system controller 158 that may be configured to control operation of the dampers 154 in response to feedback from the sensor(s). Thus, in some embodiments, the dampers 154 may further allow the cooler 100 to control the temperature within the interior cooling space 118 of the cooler 100 more precisely and/or control the temperature of the beverages and/or food products stored on the shelf 138 of the shelf plenum 136 and/or within the cooler 100 as a whole more precisely.

In some embodiments, the dampers 154 may be configured to supercool the liquid within the plurality of beverage containers 152. In other embodiments, the dampers 154 may be positioned to control different plenum shelves 136 to different target temperatures within the interior cooling space 118 of the cooler 100. For example, in a cooler 100 comprising four shelf plenums 136, the top two shelf plenums 136 may be configured to cool the beverage containers 154 on the top two shelves 138 to a normal temperature associated with a cold beverage (e.g., about 37 degrees Fahrenheit), while the bottom two shelf plenums 136 may be configured to supercool the beverage containers 154 on the bottom two shelves 138 to a supercooled temperature (e.g., about 25 degrees Fahrenheit). This may be accomplished by opening dampers 154 associated with the bottom two shelf plenums 136 to a position that allows more supply airflow 148 through the bottom two shelf plenums 136 as compared to a position of dampers 154 associated with the top two shelf plenums 136 that allows less supply airflow 148 therethrough. Alternatively, supercooled beverage containers may be on the top two shelves 138, while normally cooled beverage containers may be on the bottom two shelves 138. Moreover, the dampers 154 may be positioned to control different plenum shelves 136 to different supercool target temperatures (e.g., a first supercool target temperature for a first beverage and/or food product type on a first shelf and a second supercool target temperature for a second beverage and/or food product type on a second shelf). Furthermore, in some embodiments, each shelf plenum 136 may comprise a substantially different target temperature.

Still further, it will be appreciated that the doors 114 of the cooler 100 may comprise a switch that may halt operation of the fan 130 temporarily to prevent ambient air outside of the cooler 100 from being drawn into the interior cooling space 118 of the cooler 100. Additionally, the dampers 154 may be operated by the system controller 158 to maintain a target supply airflow 148 temperature by pulsing the dampers and/or operating a heater 160 (e.g., plurality of heating elements) disposed within the plenum 144 of each shelf plenum 136. In some embodiments, the heater 160 may ensure that the supply airflow 148 temperature remains above a threshold temperature to avoid freezing the beverage containers 154 while ensuring the beverage containers 154 remain supercooled. In some embodiments, the target supply airflow 148 temperature may be about 20 degrees Fahrenheit, about 21 degrees Fahrenheit, about 22 degrees Fahrenheit, about 23 degrees Fahrenheit, about 24 degrees Fahrenheit, and/or about 25 degrees Fahrenheit.

While the shelf plenums 136 are depicted within a cooler 100, it will be appreciated that the shelf plenums 136 and other associated components used to supercool beverages may be installed in vending machines and/or other beverage and/or food product equipment (e.g. a freezer) where precise temperature control is crucial and/or preferred. Further, it will be appreciated that the shelf plenums 136 and other associated components described herein may be installed in cooler that may not be needed to supercool beverages, but rather only cool the beverages while maintaining precise temperature control. Additionally, the shelf plenums 136 and other associated components described herein may be installed in freezers and/or deep freezers that are used to freeze beverage and/or food products while maintaining precise temperature control.

Still further, at least in some embodiments, the refrigeration system 122 may be configured to provide a heating function (by reversing the direction of refrigerant flow and/or reversing the roles of the condenser 126 and evaporator 128), such that heat may be supplied via the shelf plenums 136 to a plurality of beverages and/or food products that require heat as opposed to cooling. Furthermore, it will be appreciated that the system controller 158 may also be configured to control the refrigeration system 122 and/or the components of the refrigeration system 122 to implement the embodiments disclosed herein. For example, the system controller 158 may be configured to, inter alia, control a speed of the fan 130, control a speed of the compressor 124, receive inputs for and/or adjust a target supply airflow 148 temperature, control the position of the dampers 154, and/or operate the damper motors 156 to control the position of the dampers 154.

Figure 6:
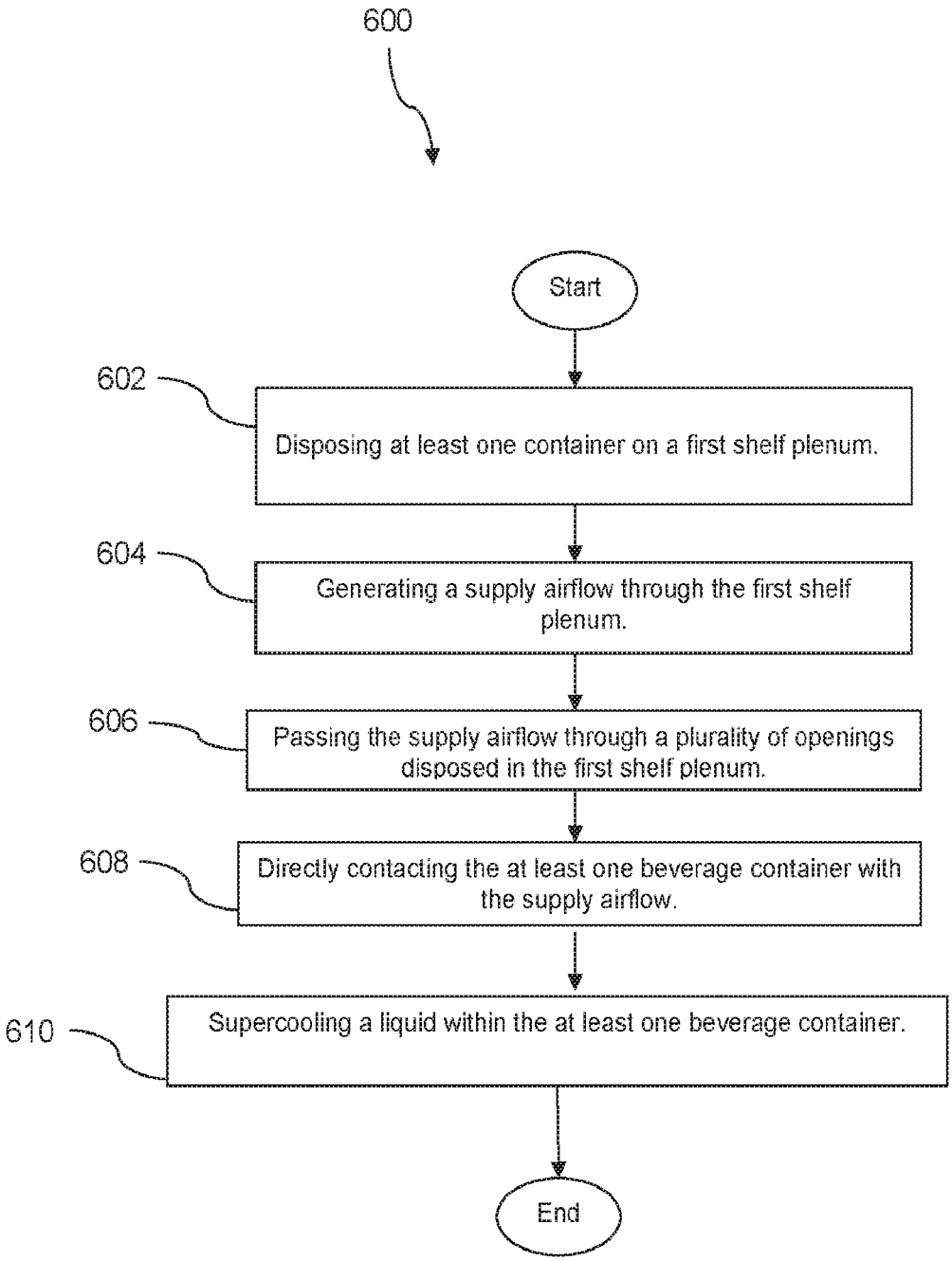
FIG. 6 is a flowchart of a method of operating a cooler according to an embodiment of the disclosure.

Referring now to FIG. 6, a flowchart of a method 600 of operating a cooler is shown according to an embodiment of the disclosure. The method 600 may begin at block 602 by disposing at least one beverage container on a first shelf plenum 136. The method 600 may continue at block 604 by generating a supply airflow 148 through the first shelf plenum 136. The method 600 may continue at block 606 by passing the supply air 148 through a plurality of openings 140 disposed on the first shelf plenum 136. The method 600 may continue at block 608 by directly contacting the at least one beverage container with the supply airflow 148. The method 600 may conclude at block 610 by supercooling a liquid within the at least one beverage container.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A cooler, comprising a supply duct;

a plurality of shelf plenums connected in fluid communication with the supply duct, each shelf plenum comprising a plenum defined by a shelf opposite a bottom portion of the shelf plenum, the shelf being configured to support a plurality of beverages thereon, and each shelf comprising a plurality of openings disposed through each shelf, the plurality of openings allowing a supply airflow received from the supply duct to pass from the shelf plenum to the interior cooling space of the cooler, and wherein at least one of the plurality of shelf plenums includes a first damper disposed within the plenum between the shelf and the bottom portion of the shelf plenum, the damper extending between, and being attached to, opposing sidewalls of the shelf plenum, the damper further being configured to control the supply airflow from through the shelf plenum to the plurality of openings;

a return duct; and a refrigeration system comprising a fan configured to generate the supply airflow.

2. The cooler of claim 1, wherein the supply airflow directly contacts the plurality of beverages through the plurality of openings.

3. The cooler of claim 2, wherein the supply airflow is configured to supercool the plurality of beverages.

4. The cooler of claim 1, further comprising a gap on each of a left side and a right side of each shelf plenum in the plurality of shelf plenums, separating each shelf plenum from a left internal wall and a right internal wall, respectively, of an internal cooling space of the cooler, and wherein a return airflow passes through the gaps to the return duct.

5. The cooler of claim 4, wherein substantially no return airflow passes through any of the plurality of shelf plenums.

6. The cooler of claim 4, wherein the return airflow exchanges substantially no heat with the plurality of beverages.

7. The cooler of claim 1, wherein each of the plurality of shelf plenums comprises at least a first damper.

8. The cooler of claim 7, wherein each first damper is selectively individually operable to control the supply airflow through each of the plurality of shelf plenums.

9. The cooler of claim 8, wherein each first damper is selectively individually operable to control a temperature of the plurality of beverages disposed on the shelf of the associated shelf plenum.

10. A cooler, comprising:

a supply duct;

at least one shelf plenum connected in fluid communication with the supply duct and extending into an interior cooling space of the cooler, the at least one shelf plenum including:

a shelf comprising a plurality of openings extending therethrough allowing a supply airflow received from the supply duct to pass from the shelf plenum to the interior cooling space of the cooler;

a bottom portion of the shelf plenum opposite the shelf;

a plenum defined by the shelf and the bottom portion of the shelf plenum, the shelf; and a damper disposed within the plenum between the shelf and the bottom portion of the shelf plenum, the damper extending between, and being attached to, opposing sidewalls of the shelf plenum, the damper being configured to control the supply airflow from the shelf plenum to the plurality of openings; and a fan configured to generate the supply airflow.

11. The cooler of claim 10, wherein the supply duct is disposed along a back wall of the cooler.

12. The cooler of claim 10, further comprising:

a plurality of shelf plenums connected in fluid communication with the supply duct, each of the shelf plenums comprising a plurality of openings disposed in a respective shelf of each of the plurality of shelf plenums.

13. The cooler of claim 10, wherein the damper comprises at least one electively operable damper.

14. The cooler of claim 10, wherein the at least one shelf plenum comprises a heater.

15. A method of operating a cooler, comprising:

disposing at least one beverage container on a first shelf plenum;

generating a supply airflow;

passing the supply airflow into a plenum in the first shelf plenum;

maintaining a target supply airflow through a plurality of openings in a shelf disposed in the first shelf plenum by manipulating a first damper disposed within the plenum between the shelf and a bottom portion of the shelf plenum, the damper extending between, and being attached to, opposing sidewalls of the shelf plenum;

directly contacting the at least one beverage container with the supply airflow; and supercooling a liquid within the at least one beverage container.

16. The method of claim 15, wherein the supercooling the liquid within the at least one beverage container comprises cooling a temperature of the liquid within the at least one beverage container to a first temperature below a freezing point of the liquid without substantially solidifying or crystallizing the liquid.

17. The method of claim 15, further comprising:

disposing at least one second beverage container on a second shelf plenum; and cooling a second liquid within the at least one second beverage container to a second temperature above a freezing point of the second liquid through manipulation of a second damper within the second shelf plenum, wherein the first temperature differs from the second temperature.

18. The method of claim 17, wherein the supercooling the liquid within the at least one beverage container disposed on the first shelf plenum and the cooling the second liquid within the at least one second beverage container to a second temperature above the freezing point of the second liquid is accomplished by passing a greater amount of supply air through the first shelf plenum as compared to an amount of supply air passed through the second shelf plenum.

19. The method of claim 18, wherein the passing a greater amount of supply air through the first shelf plenum is accomplished by selectively controlling the first damper associated with the first shelf plenum to a more open position as compared to a position of the second damper associated with the second shelf plenum.

* * * * *